US007190110B2

(12) United States Patent
Tokai et al.

(10) Patent No.: US 7,190,110 B2
(45) Date of Patent: Mar. 13, 2007

(54) LIGHT-EMITTING TUBE ARRAY DISPLAY DEVICE

(75) Inventors: Akira Tokai, Kawasaki (JP); Hitoshi Yamada, Kawasaki (JP); Manabu Ishimoto, Kawasaki (JP); Kenji Awamoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 127 days.

(21) Appl. No.: 10/716,398

(22) Filed: Nov. 20, 2003

(65) Prior Publication Data

US 2004/0108813 A1 Jun. 10, 2004

(30) Foreign Application Priority Data

Nov. 28, 2002 (JP) ..... 2002-346308

(51) Int. Cl.
*H01J 11/02* (2006.01)

(52) U.S. Cl. ..... 313/493; 313/582; 313/634

(58) Field of Classification Search ..... 313/484–493, 313/581–587, 110, 635, 634; 445/24; 345/60, 345/41; 349/122
See application file for complete search history.

(56) References Cited

U.S. PATENT DOCUMENTS 3,602,754 A * 8/1971 Pfaender et al. ..... 313/586
5,875,013 A * 2/1999 Hiroshi ..... 349/110
5,984,747 A * 11/1999 Bhagavatula et al. ..... 445/24
6,864,631 B1 * 3/2005 Wedding ..... 313/587
2001/0028216 A1 * 10/2001 Tokai et al. ..... 313/496
2001/0043170 A1 * 11/2001 Todokoro ..... 345/74.1
2001/0053029 A1 * 12/2001 Umemoto et al. ..... 359/599
2001/0054871 A1 * 12/2001 Tadaki et al. ..... 313/586
2002/0050783 A1 * 5/2002 Kubota et al. ..... 313/495
2003/0156080 A1 * 8/2003 Koike et al. ..... 345/60
2003/0176124 A1 * 9/2003 Koike et al. ..... 442/16

FOREIGN PATENT DOCUMENTS

JP 2000-315460 11/2000

* cited by examiner

*Primary Examiner*—Ashok Patel
*Assistant Examiner*—Christopher Raabe
(74) *Attorney, Agent, or Firm*—Staas & Halsey LLP

(57) ABSTRACT

A light-emitting tube array display device includes a light-emitting tube array constituted of a plurality of light-emitting tubes arranged in parallel with discharge gas filled therein, a light-transmitting supporter abutting the display surface side of the light-emitting tube array for supporting the light-emitting tube array and having electrodes formed on its surface facing the light-emitting tube array for applying a voltage to the light-emitting tubes, and a light-transmitting adhesive layer formed between the supporter and the light-emitting tube array. The adhesive layer has a refractive index equal to or higher than that of a tube body of the light-emitting tube and the supporter has a refractive index equal to or higher than that of the adhesive layer.

9 Claims, 4 Drawing Sheets

LIGHT-EMITTING TUBE ARRAY DISPLAY DEVICE

CROSS-REFERENCE TO RELATED APPLICATION

This application is related to Japanese Patent Application No. 2002-346308 filed on Nov. 28, 2002, whose priority is claimed under 35 USC §119, the disclosure of which is incorporated by reference in its entirety.

BACKGROUND OF THE INVENTION

1. Field of the Invention

The present invention relates to a light-emitting tube array display device, and more particularly to a light-emitting tube array display device for displaying optional images, in which are arranged in parallel a plurality of light-emitting tubes (also referred to as "display tubes" or "gas discharge tube") comprising narrow transparent tubes of a diameter of approximately 0.5 to 5 mm having discharge gas filled therein.

2. Description of Related Art

Such a display device as described above is characterized in that high flexibility is provided in the size of a display screen and that a display screen with a curved surface can be realized. In a display device of this kind, electrodes are generally provided outside a light-emitting tube array and a voltage is applied to those electrodes to generate an electric discharge in a discharge gas space inside each light-emitting tube.

The electrodes are disposed outside the tube array by, for instance, printing the electrodes directly on surfaces of the light-emitting tubes by means of a screen-printing method or the like, or by bringing into contact with the light-emitting tubes a supporting plate having the electrodes formed thereon (e.g. see Japanese Unexamined Patent Publication No. 2000-315460).

In a case where the supporting plate is brought into contact with the light-emitting tubes as described above, an adhesive layer is needed at the interface between the electrode and the light-emitting tube so as to obtain good adhesion.

However, in taking out light emitted from the light-emitting tubes as display light, light incident at an angle greater than a critical angle is totally reflected to cause a loss of light in a case where a light-incident substance is higher in refractive index than a light-transmitted substance at a certain interface between two dissimilar substances. Therefore, when a number of interfaces between dissimilar substances exist due to the formation of an adhesive layer and the like, the loss of light is repeated at these interfaces, resulting in a problem that the luminance of a display device is decreased.

SUMMARY OF THE INVENTION

The present invention has been made in view of these circumstances and its object is to provide a light-emitting tube array display device in which an adhesive layer, a supporting plate and light-emitting tubes are arranged in such a manner that their refractive indices become equal or increase in traveling order of light so that light emitted from each light-emitting tube is not subject to total internal reflection caused by refraction at the interfaces between the light-emitting tube and the adhesive layer and between the adhesive layer and the supporting plate and the light can be taken out efficiently toward the display surface side of the device.

The present invention provides a light-emitting tube array display device comprising: a light-emitting tube array constituted of a plurality of light-emitting tubes arranged in parallel with discharge gas filled therein; a light-transmitting supporter abutting the display surface side of the light-emitting tube array for supporting the light-emitting tube array and having electrodes formed on its surface facing the light-emitting tube array for applying a voltage to the light-emitting tubes; and a light-transmitting adhesive layer formed between the supporter and the light-emitting tube array, wherein the adhesive layer has a refractive index equal to or higher than that of a tube body of each light-emitting tube.

The present invention also provides a light-emitting tube array display device comprising: a light-emitting tube array constituted of a plurality of light-emitting tubes arranged in parallel with discharge gas filled therein; a light-transmitting supporter abutting the display surface side of the light-emitting tube array for supporting the light-emitting tube array and having electrodes formed on its surface facing the light-emitting tube array for applying a voltage to the light-emitting tubes; and a light-transmitting adhesive layer formed between the supporter and the light-emitting tube array, wherein the supporter has a refractive index equal to or higher than that of the adhesive layer.

According to the present invention, the refractive index of the adhesive layer is set to be equal to or higher than that of the tube body of the light-emitting tube or the refractive index of the supporter is set to be equal to or higher than that of the adhesive layer. Therefore, light emitted from the light-emitting tube is not subject to total internal reflection caused by refraction at the interfaces between the light-emitting tube and the adhesive layer and between the adhesive layer and the supporter and the light can be taken out efficiently toward the display surface side of the device.

DESCRIPTION OF THE PREFERRED EMBODIMENTS

Figure 1:
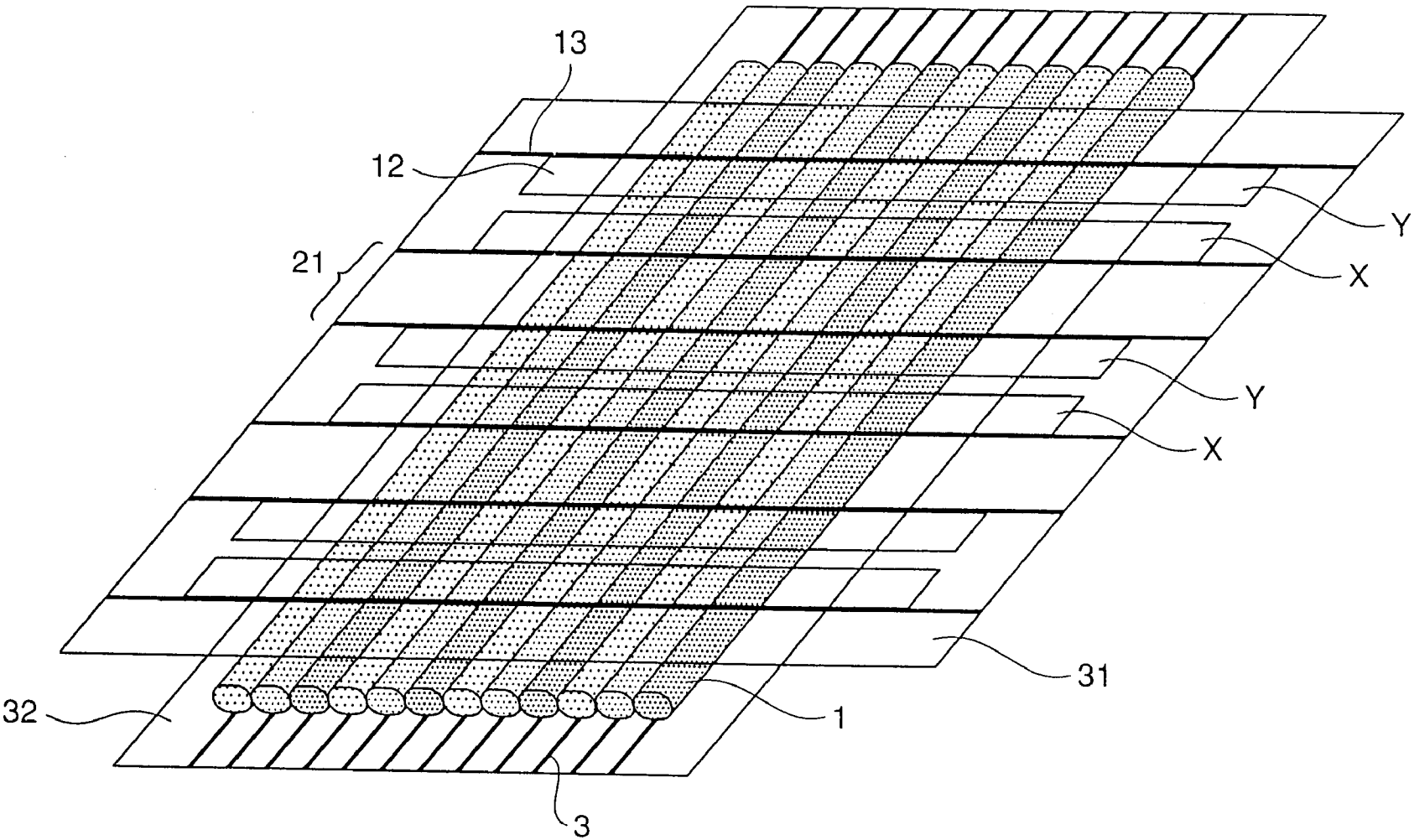
FIG. 1 is a view illustrating a general construction of a light-emitting tube array display device according to an embodiment of the present invention.

A usable light-emitting tube array in the present invention may be any array constituted of a plurality of light-emitting tubes arranged in parallel with discharge gas filled therein. A narrow tube to be used as a tube body of each light-emitting tube is not specifically limited in diameter, but it is preferable that a glass tube having a diameter of approximately 0.5 to 5 mm is used. The sectional shape of the narrow tube is not specifically limited; it may be, for example, circular, flat oval, or substantially quadrilateral. However, from the viewpoint of allowing a large contact area between the light emitting tube and an electrode, it is preferable that the sectional shape of the narrow tube is, for example, flat oval or substantially quadrilateral with a flat portion provided on its surface facing a supporter. A narrow tube having such a sectional shape allows the electrode on the supporter to face the flat portion of the narrow tube when the supporter abuts the flat portion of the tube, and thus makes it possible to make larger the contact area between the light-emitting tube and the electrode than in a case where a narrow tube having the circular sectional shape is used.

Usable as a supporter in the present invention is any supporter that abuts the display surface side of the light-emitting tube array to support the tube array; that has electrodes formed on its surface facing the tube array for applying a voltage to the light-emitting tubes; that have a refractive index higher than that of the tube body of the light-emitting tube; and that is light-transmissive.

Usable as such a supporter as described above is, for example, a flexible resin sheet having a refractive index higher than that of the tube body of the light-emitting tube or a substrate made of glass. As the flexible resin sheet, a light-transmitting film sheet may be mentioned. Usable as a film for this film sheet is, for example, a commercially available PET (polyethylene terephthalate) film having a refractive index of about 1.58 or the like, since it has a refractive index higher than that the tube body of the light-emitting tube. In a case where the tube body of the light-emitting tube is made of borosilicate glass generally having a refractive index of about 1.47, a substrate made of normal soda lime glass having a refractive index higher than that of the borosilicate glass may be used as the glass substrate.

A usable supporter in the present invention supports the tube array at the display surface side of the tube array, but if possible, it is desirable that a pair of supporters are provided so as to support the tube array at both the display surface side and the rear side of the tube array. When the pair of supporters are provided, it is not necessarily required that two supporters are made of the same material; the pair of supporters may be formed of different materials in any combination. For example, one of the supporters may be formed of resin and the other may be formed of glass.

Desirably, the supporter is in a sheet form or a flat-plate form and has such size that it covers almost the whole tube array so that the whole tube array can be supported.

Electrodes in the present invention are not particularly limited and can be any electrodes that are formed on the surface of the supporter facing the tube array and that are capable of generating a discharge in a discharge gas space inside each light-emitting tube by the application of a voltage. These electrodes may be formed using materials and methods known in the art. For example, the electrodes may be formed by forming a copper film or the like film on a surface of the above-mentioned flexible sheet facing the tube array by a low-temperature sputtering method, a vapor deposition method or a plating method, and then patterning the film thus formed using a known photolithography technique. In addition to the above, examples of a material for the electrodes include nickel, aluminum, silver and the like. Examples of a method for forming the electrodes include a printing method in addition to the above-mentioned sputtering method, the vapor deposition method and the plating method.

Desirably, the electrodes are provided so as to form a plurality of discharge regions inside each light-emitting tube along the longitudinal direction thereof. From this point of view, it is desirable that the electrodes are formed on the surface of the display surface side supporter facing the tube array and on the surface of the rear side supporter facing the tube array as main electrodes and data electrodes, respectively. The main electrodes are formed in a direction crossing the longitudinal direction of the light-emitting tubes and the data electrodes are formed along the longitudinal direction of the light-emitting tubes.

Usable as an adhesive layer in the present invention may be any layer that is formed between the supporter and the light-emitting tubes; that has a refractive index higher than that of the tube body of the light-emitting tube and lower than that of the supporter; and that is light-transmissive.

Usable as such an adhesive layer as described above is any layer that has a refractive index in the range of, for instance, 1.47 to 1.58 when the tube body of the light-emitting tube is made of borosilicate glass having a refractive index of about 1.47 and the supporter is a film sheet made of polyethylene terephthalate having a refractive index of about 1.58. The adhesive layer can be formed of a transparent acrylic adhesive. As such an adhesive, EXP-090 manufactured by Sumiotomo 3M Ltd., may be mentioned. Also, a transparent adhesive tape such as a highly transparent adhesive transfer tape known under the trade name of Optically Clear Laminating Adhesive #8141, #8142 or #8161 manufactured by Sumitomo 3M Ltd., or the like may be used as an adhesive layer.

When the refractive index of the adhesive layer is in the above-mentioned range, it is possible to eliminate total internal reflection of light emitted from the light-emitting tube at the interfaces between the light-emitting tube and the adhesive layer and between the adhesive layer and the supporter. This allows the light emitted from the light-emitting tube to be taken out in a sufficient amount toward the display surface side of the device.

Desirably, a resin layer such as the above-mentioned transparent acrylic adhesive is formed in the space among the adjacent light-emitting tubes and the supporter. If this space is empty, a portion of light passing from the light-emitting tube to air is totally reflected at the interface between the light-emitting tube and air since air in the space is lower than the light-emitting tube in refractive index. However, by forming the resin layer in the space, such total internal reflection is prevented and the light emitted from the light-emitting tube can be efficiently taken out toward the display surface side of the device.

Further, one or more film(s) or substrate(s) having a refractive index higher than that of the supporter may be disposed on the display surface side of the supporter. In a case where the plurality of films or substrates are disposed, it is desirable that these films or substrates are arranged in such a manner that their refractive indices increase successively with distance from the supporter. By arranging the films or substrates as described above, total internal reflection is prevented at the interfaces between the supporter and one of the films or substrates and between said one of the films or substrates and the other film or substrate disposed thereon. As a result of this, light emitted from the light-emitting tube can be efficiently taken out toward the display surface side of the device.

The following is a description of the present invention according to the embodiments shown in the figures. However, it should be understood that the present invention is not limited thereto and various modifications can be made.

FIG. 1 is a view illustrating a general construction of a light-emitting tube display device according to an embodiment of the present invention. The display device of the present invention is a light-emitting tube array display device for displaying optional images comprising a plurality of light-emitting tubes arranged in parallel, wherein the light-emitting tubes are constituted of narrow glass tubes having a diameter of approximately 0.5 to 5 mm with phosphor layers disposed and discharge gas filled therein.

In the figure, reference numeral 31 denotes a front side (display surface side) supporter (substrate), 32 denotes a rear side supporter (substrate), 1 denotes a light-emitting tube, reference marks X and Y denote a pair of display electrodes (pair of main electrodes), and reference numeral 3 denotes a data electrode (also referred to as a signal electrode).

The front side supporter 31 and the rear side supporter 32 are made of a flexible sheet such as a PET film. One or both of these supporters 31 and 32 may be a flat glass plate made of soda-lime glass or the like. In order to obtain a fine display contrast, the rear side supporter 32 is preferably opaque. A tube body of the light-emitting tube 1 is made of borosilicate glass or the like.

The pair of display electrodes X and Y are formed on a surface of the front side supporter 31 facing the tube array. Each electrode of the pair of display electrodes X and Y is composed of a transparent electrode 12 made of ITO, $SnO_2$ or the like and a bus electrode 13 made of a metal such as copper, nickel, aluminum or chromium. In addition to the above, the display electrodes X and Y each may be composed of only a metal electrode having a mesh-pattern or a comb-shape with no transparent electrode used. The electrode having the mesh-pattern or the comb-shape is formed by a sputtering method, a vapor-deposition method, a plating method or the like.

The data electrode 3 is formed on a surface of the rear side supporter 32 facing the tube array. Since the data electrode 3 may be opaque, it is formed by the sputtering method, the vapor-deposition method, the plating method or the printing method, using nickel, copper, aluminum or silver but not using ITO or $SnO_2$.

The phosphor layers (not shown) of three primary colors of R (red), G (green), and B (blue) are provided individually in respective discharge spaces inside the light-emitting tubes 1 and the discharge gas containing neon and xenon is introduced therein, and then both ends of the tubes are sealed to form discharge gas spaces inside the light-emitting tubes. The light-emitting tube array is constituted of these light-emitting tubes 1 arranged in parallel. As described above, the data electrodes 3 are formed on the rear side supporter 32 so as to be in contact with the light-emitting tubes 1 along the longitudinal direction thereof. The pair of display electrodes X and Y are formed on the front side supporter 31 so as to be in contact with the light-emitting tubes 1 in the direction crossing the data electrodes 3. A non-discharge region (non-discharge gap) 21 is provided between the adjacent pairs of display electrodes X and Y.

The data electrode 3 and the pair of display electrodes X and Y are brought into close contact with the rear side outer periphery and front side outer periphery, respectively, of the light-emitting tube 1 during assembly. In order to improve adhesion between the pair of display electrodes X and Y and the light-emitting tube, the supporter having the display electrodes formed thereon and the light-emitting tube are bonded together with an adhesive provided therebetween.

When the display device of the embodiment is seen in a plan view, a portion where the data electrode 3 and the pair of display electrodes X and Y cross each other serves as a unit light-emitting region (unit discharge region). Display is performed as follows: using one electrode of the pair of display electrodes X and Y as a scanning electrode, a selective discharge is generated in a portion where the scanning electrode and the data electrode 3 cross each other to select a light-emitting region, and using wall charges which are formed on the internal surface of the tube in the selected light-emitting region at the time of light-emission by the selective discharge, a display discharge is generated between the display electrodes X and Y. The selective discharge is an opposition discharge generated in the light-emitting tube 1 between the scanning electrode and data electrode 3 which are opposed to each other in a vertical direction. The display discharge is a surface discharge generated in the light-emitting tube 1 between the display electrodes X and Y arranged in parallel on a plane.

Such an electrode arrangement as described above forms a plurality of light-emitting regions inside each light-emitting tube 1 along the longitudinal direction thereof.

In the electrode structure shown in the figure, three electrodes are arranged at one light-emitting region and a display discharge is generated by the pair of display electrodes X and Y. However, the electrode structure of the present invention is not limited thereto and may be such that a display discharge is generated between either one of the display electrodes X and Y and the data electrode 3.

In other words, the electrode structure may be such that the pair of display electrodes X and Y are assumed to be a single electrode and this electrode is used as the scanning electrode so that a selective discharge and a display discharge (opposition discharge) are generated between the data electrode 3 and said scanning electrode.

Figure 2:
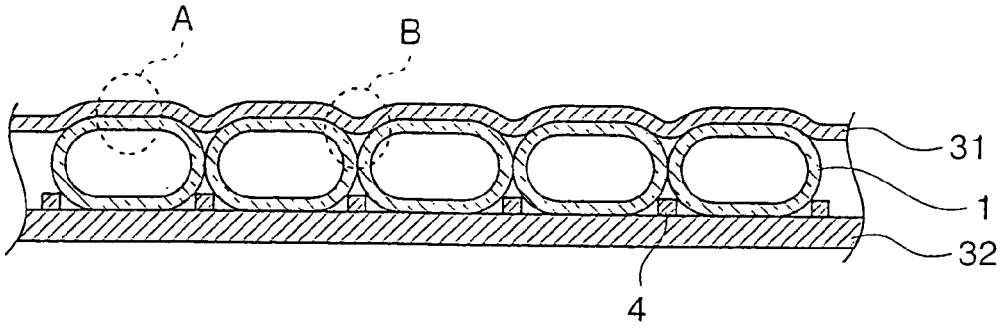
FIG. 2 is a view illustrating a cross section of the light-emitting tube array display device according to the embodiment.

FIG. 2 is a view illustrating a cross section of the light-emitting tube array display device. This figure shows a cross section orthogonal to the longitudinal direction of the light-emitting tubes.

A narrow glass tube is used as the tube body of the light-emitting tube 1. This narrow tube has a flat oval cross section, is made of Pyrex (registered trademark: heat-resistant glass made by Coring Inc., U.S.A.), and has a major axis of 1.0–1.5 mm, a minor axis of 0.7–0.9 mm, a wall thickness of 0.07–0.1 mm, and a length of 220–300 mm.

A narrow tube constituting the tube body of the light-emitting tube 1 is made by producing a cylindrical tube by Danner Process, molding the cylindrical tube by heating to produce a glass base material having a figure similar to the narrow tube to be made, and redrawing (extending) the glass base material while softening it by heating.

The display surface side supporter 31 is made of a transparent PET film. The pair of display electrodes (not shown) is formed on the surface of the front side supporter 31 facing the tube array. An adhesive layer (not shown) is formed between the front side supporter 31 and the light-emitting tubes 1.

As the rear side supporter 32, an opaque substrate made of resin is used. The data electrodes (not shown) are formed on the surface of the rear side supporter 32 facing the tube array. Further, a partitioning member 4 for keeping the light-emitting tube 1 in its position is provided on the surface of the rear side supporter 32 facing the tube array. However, this partitioning member 4 is not necessarily required.

Figure 3:
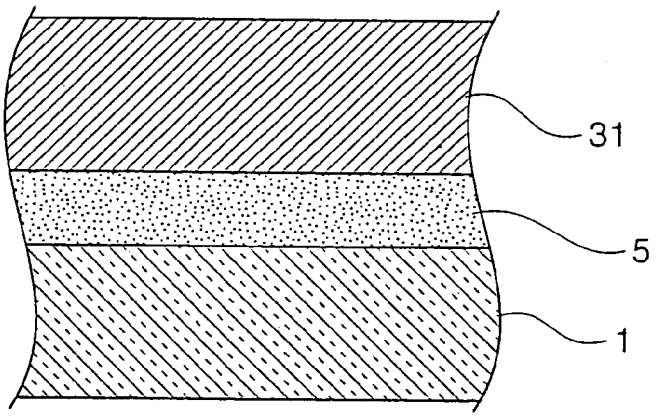
FIG. 3 is an enlarged view of the circular region labeled A in FIG. 2.

FIG. 3 is an enlarged view illustrating the circular region labeled A in FIG. 2. In the figure, reference numeral 5 denotes the adhesive layer. The pair of display electrodes are not shown.

The narrow glass tube serving as the tube body of the light-emitting tube 1 is made of Pyrex and its refractive index $n_T$ is 1.47. The display surface side supporter 31 is made of the PET film and its refractive index $n_S$ is 1.576.

The adhesive layer 5 is formed using an acrylic adhesive called EXP-090 manufactured by Sumitomo 3M Ltd. EXP-090 is a liquid adhesive of an ultraviolet-curing type and can be filled into a space among the adjacent light-emitting tubes 1 and the supporter 31. The refractive index $n_R$ of EXP-090 is 1.50.

In addition to the above, a highly transparent adhesive transfer tape known under the trade name of Optically Clear Laminating Adhesive #8141, #8142 or #8161 manufactured by Sumitomo 3M Ltd., or the like may be used as the adhesive layer 5. The highly transparent adhesive transfer tape is an adhesive in a sheet form such as a double-faced tape. The adhesive transfer tapes #8141, #8142, and #8161 have refractive indices of 1.47. The adhesive EXP-090 and the adhesive transfer tapes #8141, #8142 and #8161 each have a high visible light transmittance of 90% or more.

The refractive indices of the materials described above are listed below.

| | |
|---|---|
| Refractive index $n_T$ of the tube body (Pyrex): | 1.47 |
| Refractive index $n_R$ of the adhesive layer (EXP-090): | 1.50 |
| Refractive index $n_R$ of the adhesive layer (#8141 or the like): | 1.47 |
| Refractive index $n_S$ of the supporter (PET film): | 1.576 |

Figure 4:
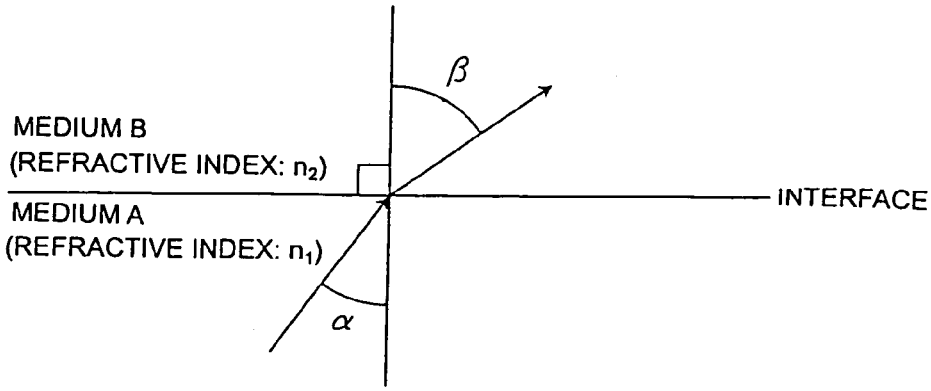
FIG. 4 is a view illustrating an example of refraction of light in transmission through the interface between two dissimilar media.

FIG. 4 is a view illustrating an example of refraction of light in transmission through the interface between two dissimilar media.

Supposing that the refractive index of a medium A is $n_1$ and the refractive index of a medium B is $n_2$, light passing from the medium A into medium B at an angle $\alpha$ with a line perpendicular to the interface (a normal line) is refracted at the interface at an angle $\beta$ with the normal (0 degree$\leqq\alpha$, $\beta\leqq$90 degrees).

Snell's law $n_1 \cdot \sin\alpha = n_2 \cdot \sin\beta$ holds for the above condition. From this equation, $\sin\alpha/\sin\beta = n_2/n_1$ is obtained.

Therefore, when the relationship between the refractive index $n_1$ of the medium A and the refractive index $n_2$ of the medium B is $n_1 > n_2$, $\sin\beta > \sin\alpha$ is given. Hence, when the angle $\beta$ is 90 degrees, light incident at an angle greater than the angle $\alpha$ is totally reflected.

Figure 5:
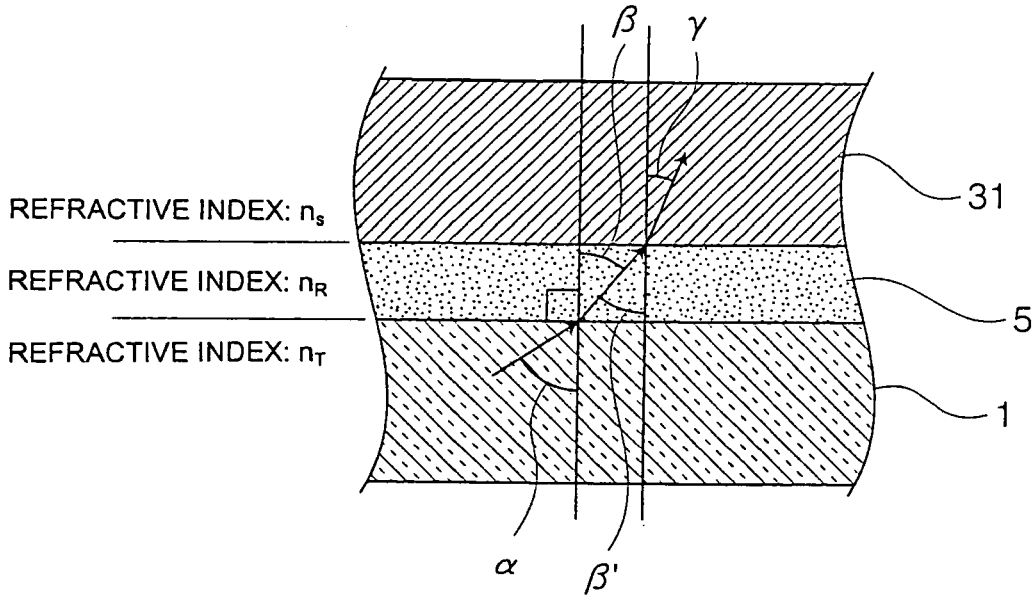
FIG. 5 is a view illustrating the relationship among the refractive indices of a tube body of a light-emitting tube, an adhesive layer and a supporter according to the embodiment.

FIG. 5 is a view illustrating the relationship among the refractive indices of the tube body of the light-emitting tube, the adhesive layer and the supporter.

When the relationship between the refractive indices of the medium A and the medium B is replaced with the relationship between the refractive index $n_T$ of the tube body of the light-emitting tube 1 and the refractive index $n_R$ of the adhesive layer 5, $\sin\alpha/\sin\beta = n_R/n_T$ holds at the interface between the tube body of the light-emitting tube 1 and the adhesive layer 5, from Snell's law (0 degree$\leqq\alpha$, $\beta\leqq$90 degrees).

In this example, since $n_T(1.47) < n_R(1.50)$ is given, $\sin\beta < \sin\alpha$ is obtained as described above. Therefore, no total internal reflection occurs for light incident at any angle $\alpha$, and the entire light emitted from the light-emitting tube 1 at any given angle $\alpha$ enters the adhesive layer 5. For this reason, the adhesive layer 5 having a refractive index that satisfies the condition of $n_T \leqq n_R$ is used. In other words, by establishing the refractive index of the tube body$\leqq$the refractive index of the adhesive layer, the influence of refraction (total internal reflection) at the interface between the light-emitting tube and the adhesive layer is eliminated and the entire light emitted from the light-emitting tube can be taken out toward the display surface side of the adhesive layer.

Further, $\sin\beta'/\sin\gamma = n_S/n_R$ holds at the interface between the adhesive layer 5 and the supporter 31, from Snell's law (0 degree$\leqq\beta'$, $\gamma\leqq$90 degrees).

In this example, since $n_R(1.50) \leqq n_S(1.576)$ is given, $\sin\gamma \leqq \sin\beta'$ is obtained as described above. Therefore, no total internal reflection occurs for light incident at any angle $\beta'$, and the entire light transmitted through the adhesive layer 5 at any given angle $\beta'$ enters the supporter 31. For this reason, the adhesive layer 5 having a refractive index that satisfies the condition of $n_R \leqq n_S$ is used. In other words, by establishing the refractive index of the adhesive layer$\leqq$the refractive index of the supporter, the influence of refraction at the interface between the adhesive layer and the supporter is eliminated and the entire light transmitted through the adhesive layer can be taken out toward the display surface side of the supporter.

By setting the refractive indices of the materials to be in such a relationship that the refractive index of the tube body$\leqq$the refractive index of the adhesive layer$\leqq$the refractive index of the supporter, the influence of refraction at the interface between the light-emitting tube and the adhesive layer is eliminated and the entire light emitted from the light-emitting tube side can be taken out to the supporter side.

The display luminance is approximately 450 cd/m$^2$ when the light-emitting tubes 1 arranged in parallel in an array form emit light. However, the presence of the front side supporter 31 and the adhesive layer 5 decreases the display luminance. For display devices for indoor applications, the luminance required is approximately 300 cd/m$^2$. Therefore, when the PET film is used as the front side supporter 31, the adhesive layer 5 needs to have a transmittance of 75% or more supposing that the transmittance of the PET film is 90%. Thus, in order to realize a display device having a luminance of 300 cd/m$^2$, the adhesive layer desirably has a transmittance of 75% or more.

Figure 6:
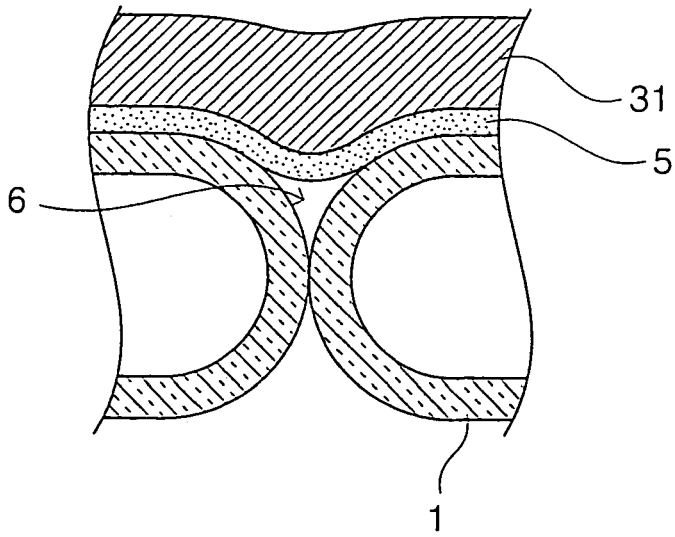
FIG. 6 is an enlarged view illustrating the circular region labeled B in FIG. 2.

FIG. 6 is an enlarged view illustrating the circular region labeled B in FIG. 2. In the figure, reference numeral 6 denotes a space among the adjacent light-emitting tubes and the supporter. The pair of display electrodes are not shown.

In the display device having light-emitting tubes 1 arranged in parallel in an array form, the space 6 appears among the adjacent light-emitting tubes 1 and the supporter 31 as shown in the figure. In general, air is present in this space 6. Since the refractive index $n_A$ of air is lower than the refractive index $n_T$ of Pyrex (1.47) serving as the tube body of the light-emitting tube 1, light emitted from the light-emitting tube 1 to the space 6 is totally reflected when the light incident angle is in a certain range.

Figure 7:
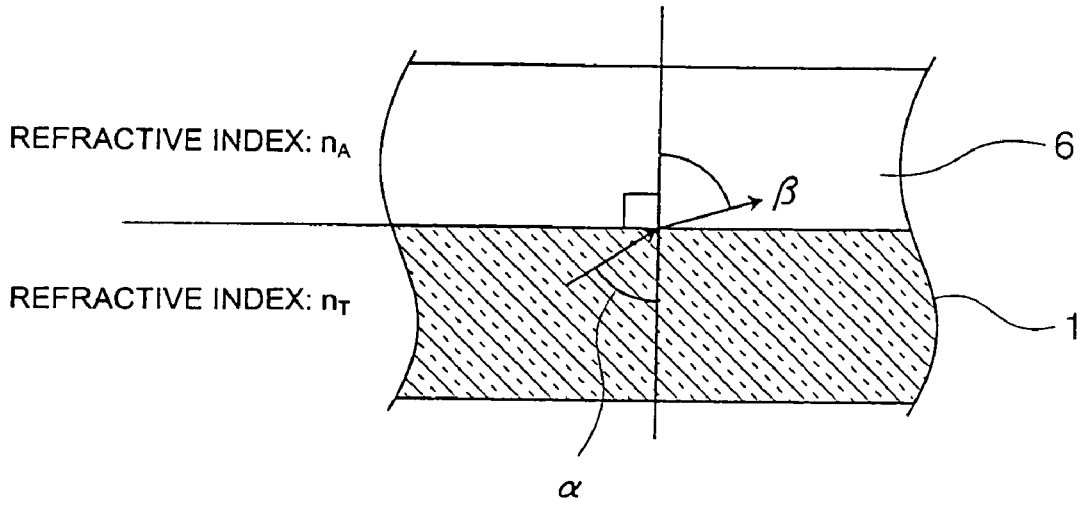
FIG. 7 is a view illustrating refraction of light at the interface between the tube body of the light-emitting tube and air.

FIG. 7 is a view illustrating the refraction of light at the interface between the tube body of the light-emitting tube and air.

In a case where the space 6 appears among the adjacent light-emitting tubes 1 and the supporter 31, since the relationship between the refractive index $n_T$ of Pyrex serving as the tube body of the light-emitting tube 1 and the refractive index $n_A$ of air is $n_T > n_A$, $\sin\beta > \sin\alpha$ is obtained, and light incident at an angle in a certain range is totally reflected. In other words, when a substance having a refractive index lower than that of the tube body of the light-emitting tube 1 (air) is present in the space 6, light emitted from the light-emitting tubes 1 is subject to total internal reflection caused by refraction.

For the reason described above, the adhesive layer 5 having a refractive index higher than that of the tube body of the light-emitting tube 1 is also formed in the space 6. The adhesive layer 5 is formed in the space 6 by filling into this space 6 the above-mentioned liquid adhesive of an ultraviolet-curing type called EXP-090 which is manufactured by Sumitomo 3M Ltd.

By filling into the space 6 a material having a refractive index equal to or higher than that of the tube body of the light-emitting tube 1 as described above, the influence of total internal reflection is eliminated at the interface between the light-emitting tube 1 and air, thereby allowing light emitted in the lateral direction of the light-emitting tube to be also taken out toward the display surface side of the device.

Usable as material to be filled into the space 6 is any material having a refractive index equal to or higher than that of the tube body of the light-emitting tube 1, and, for example, synthetic resins other than the above-mentioned liquid adhesive may be used.

Figure 8:
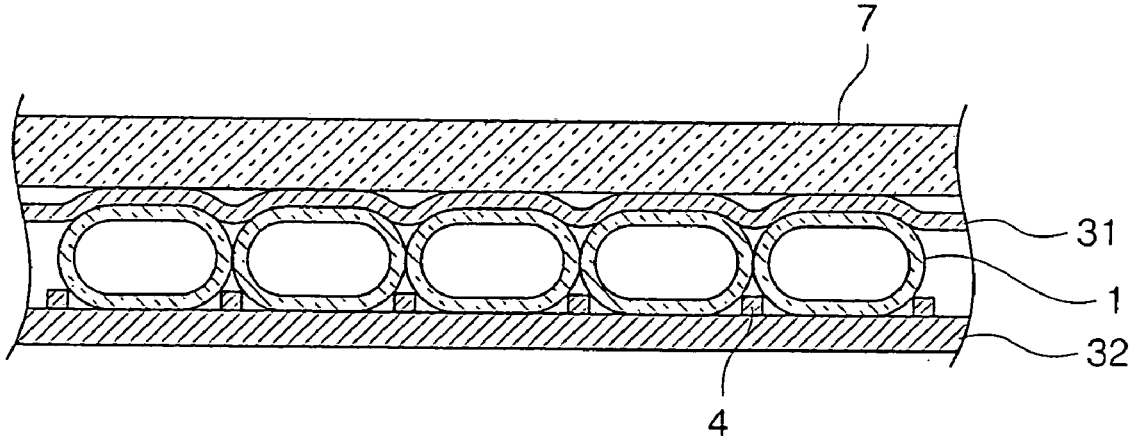
FIG. 8 is a view illustrating an example of a light-transmitting substrate disposed on a front side supporter.

FIG. 8 is a view illustrating an example of a light-transmitting substrate disposed on the front side supporter. In the figure, the adhesive layer is not shown.

In a case where the front supporter 31 is in a form of a thin film such as the PET film, there is a fear that a breakage of the light-emitting tube 1 may be caused by the external pressure from the display surface side. For this reason, a light-transmitting substrate 7 for protecting the display device is provided on the front surface (the display surface side) of the front side supporter 31.

As the light-transmitting substrate 7, polycarbonate (having a refractive index of 1.59) or polyether sulphone (having a refractive index of 1.642) which is a transparent plastic having a refractive index higher than that of the above-mentioned adhesive layer (1.47–1.50) is used.

The use of the light-transmitting substrate 7 having such a refractive index satisfies the following relationship: the refractive index of the tube body≦the refractive index of the adhesive layer≦the refractive index of the supporter 31≦the refractive index of the light-transmitting substrate 7. Accordingly, light emitted from the light-emitting tube 1 is not subject to total internal reflection caused by refraction at each interface and can be taken out toward the display surface side of the device.

A filter plate for adjusting color and contrast of display or a light-transmitting substrate having an antireflection film against external light may be provided in place of the light-transmitting substrate 7, or may be provided additionally on the front side or the rear side of the substrate 7. Further, the substrate 7 may be a single-layer or multilayer transparent film.

In a case where a plurality of light-transmitting substrates or transparent films having refractive indices higher than that of the supporter are provided on the front surface of the front side supporter 31, the substrates or films are arranged in such a manner that their refractive indices increase successively with distance from the supporter 31. This serves to satisfy the following relationship: the refractive index of the tube body≦the refractive index of the adhesive layer≦the refractive index of the supporter≦the refractive index of the light-transmitting substrate≦, . . . , ≦the refractive index of the light-transmitting substrate. Accordingly, light emitted from the light-emitting tube 1 is not subject to total internal reflection caused by refraction at each interface and can be taken out toward the display surface side of the device.

As described above, by arranging the adhesive layer, the front side supporter and the like on the front surface of the light-emitting tubes in such a manner that their refractive indices fulfill the above-mentioned relationship, light emitted from the light-emitting tube is not subject to total internal reflection caused by refraction at the interfaces between the adjacent materials and can be efficiently taken out toward the display surface side of the device. When the refractive indices of the materials increase with increasing proximity to the display surface as described above, concerns are raised for the influence of light reflection at the front surface of the display surface side supporter of the display device. This problem, however, can be alleviated by antiglare treatment.

According to the present invention, the refractive index of the adhesive layer is set to be higher than that of the tube body of the light-emitting tube or the refractive index of the supporter is set to be higher than that of the adhesive layer. Therefore, light emitted from the light-emitting tube is not subject to total internal reflection caused by refraction at the interfaces between the light-emitting tube and the adhesive layer and between the adhesive layer and the supporter and the light can be taken out efficiently toward the display surface side of the device.

What is claimed is:

1. A light-emitting tube array display device comprising:

a light-emitting tube array constituted of a plurality of light-emitting tubes arranged in parallel with discharge gas filled therein;

a light-transmitting supporter abutting a display surface side of the light-emitting tube array for supporting the light-emitting tube array and having electrodes, crossing the light emitting tubes and formed on a surface of the supporter facing the light-emitting tube array, for applying a voltage to the light-emitting tubes;

a phosphor layer formed on a rear side inner wall of each light-emitting tube;

a light-transmitting adhesive layer formed between the supporter and the light-emitting tube array;

a rear side substrate abutting a surface of each light-emitting tube so that the light-emitting tube array is held between the supporter and the rear side substrate;

electrodes formed on a surface of the rear side substrate facing the light-emitting tubes and extending in a direction crossing the electrodes formed on the surface of the supporter; and a resin layer filled into a space formed by display surface sides of adjacent light-emitting tubes and the supporter, to thereby eliminate total internal reflection of light emitted from the adjacent light-emitting tubes into the space that would occur due to air that would be in the space if the resin layer was not filled into the space, wherein the adhesive layer has a refractive index equal to or higher than that of a tube body of each light-emitting tube.

2. A light-emitting tube array display device comprising:

a light-emitting tube array constituted of a plurality of light-emitting tubes arranged in parallel with discharge gas filled therein;

a light-transmitting supporter abutting a display surface side of the light-emitting tube array for supporting the light-emitting tube array and having electrodes, crossing the light-emitting tubes and formed on a surface of the supporter facing the light-emitting tube array, for applying a voltage to the light-emitting tubes;

a phosphor layer formed on a rear side inner wall of each light-emitting tube;

a light-transmitting adhesive layer formed between the supporter and the light-emitting tube array;

a rear side substrate abutting a surface of each light-emitting tube so that the light-emitting tube array is held between the supporter and the rear side substrate;

electrodes formed on a surface of the rear side substrate facing the light-emitting tubes and extending in a direction crossing the electrodes formed on the surface of the supporter; and a resin layer filled into a space formed by display surface sides of adjacent light-emitting tubes and the supporter, to thereby eliminate total internal reflection of light emitted from the adjacent light-emitting tubes into the space that would occur due to air that would be in the space if the resin layer was not filled into the space, wherein the supporter has a refractive index equal to or higher than that of the adhesive layer.

3. A light-emitting tube array display device comprising:

a light-emitting tube array constituted of a plurality of light-emitting tubes arranged in parallel with discharge gas filled therein;

a light-transmitting supporter abutting a display surface side of the light-emitting tube array for supporting the light-emitting tube array and having electrodes, crossing the light-emitting tubes and formed on a surface of the supporter facing the light-emitting tube array, for applying a voltage to the light-emitting tubes;

a phosphor layer formed on a rear side inner wall of each light-emitting tube;

a light-transmitting adhesive layer formed between the supporter and the light-emitting tube array;

a rear side substrate abutting a surface of each light-emitting tube so that the light-emitting tube array is held between the supporter and the rear side substrate;

electrodes formed on a surface of the rear side substrate facing the light-emitting tubes and extending in a direction crossing the electrodes formed on the surface of the supporter; and a resin layer filled into a space formed by display surface sides of adjacent light-emitting tubes and the supporter, to thereby eliminate total internal reflection of light emitted from the adjacent light-emitting tubes into the space that would occur due to air that would be in the space if the resin layer was not filled into the space, wherein the adhesive layer has a refractive index equal to or higher than that of a tube body of each light-emitting tube, and the supporter has a refractive index higher than that of the adhesive layer.

4. The light-emitting tube array display device according to claim 3, wherein the refractive index of the tube body of each light-emitting tube is equal to or less than 1.47, the refractive index of the adhesive layer is 1.47–1.50, and the refractive index of the supporter is equal to or higher than 1.50.

5. The light-emitting tube array display device according to claim 1, 2 or 3, wherein the supporter is a flexible resin sheet.

6. The light-emitting tube array display device according to claims 1 or 3, wherein the supporter is a flexible resin sheet, and the tube body of each light-emitting tube is made of borosilicate glass, the flexible resin sheet is made of polyethylene terephthalate, and the adhesive layer is made of acrylic resin.

7. The light-emitting tube array display device according to claim 1, 2 or 3, wherein each light-emitting tube has a flat portion provided on its surface facing the supporter and a cross section that allows the flat portion to face at least one electrode of the supporter when the supporter abuts the flat portion.

8. The light-emitting tube array display device according to claim 1, 2 or 3, further comprising one or more film(s) or substrate(s) having a refractive index higher than that of the supporter, the one or more film(s) or substrate(s) being disposed on a display surface side of the supporter in such a manner that their refractive indices increase successively with distance from the supporter.

9. The light-emitting tube array display device according to claim 2, wherein the supporter is a flexible resin sheet, each light-emitting tube has a tube body made of borosilicate glass, the flexible resin sheet is made of polyethylene terephthalate, and the adhesive layer is made of acrylic resin.

* * * * *